US009228481B2

(12) United States Patent
Itakura

(10) Patent No.: US 9,228,481 B2
(45) Date of Patent: Jan. 5, 2016

(54) WATER PUMP MOUNTING STRUCTURE IN INTERNAL COMBUSTION ENGINE

(71) Applicant: HONDA MOTOR CO., LTD., Tokyo (JP)

(72) Inventor: Jun Itakura, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 533 days.

(21) Appl. No.: 13/678,552

(22) Filed: Nov. 16, 2012

(65) Prior Publication Data

US 2013/0129500 A1 May 23, 2013

(30) Foreign Application Priority Data

Nov. 18, 2011 (JP) ..... 2011-252710

(51) Int. Cl.
*F01P 5/10* (2006.01)
*F02F 7/00* (2006.01)

(52) U.S. Cl.
CPC *F01P 5/10* (2013.01); *F02F 7/0073* (2013.01)

(58) Field of Classification Search
CPC ..... F02F 7/0073; F04D 29/605
USPC ..... 123/195 R, 195 C, 41.01, 41.72
See application file for complete search history.

(56) References Cited

U.S. PATENT DOCUMENTS

2007/0122294 A1* 5/2007 Wizgall et al. ..... 417/362

FOREIGN PATENT DOCUMENTS

| | | |
|---|---|---|
| JP | 04-012134 | 1/1992 |
| JP | 11-210463 | 8/1999 |
| JP | 2006-152969 | 6/2006 |
| JP | 2008-202444 | 9/2008 |

OTHER PUBLICATIONS

Japanese Office Action for corresponding JP Application No. 2011-252710, Aug. 12, 2013.

* cited by examiner

*Primary Examiner* — Dwayne J White
*Assistant Examiner* — Alexander White
(74) *Attorney, Agent, or Firm* — Mori & Ward, LLP

(57) ABSTRACT

A water pump mounting structure includes a water pump cover and a water pump housing. The water pump housing includes an upper extending portion and a lower extending portion. The upper extending portion includes a first upper fastening portion and a second upper fastening portion. The second upper fastening portion is provided between the first upper fastening portion and a pump driving shaft. The lower extending portion includes a first lower fastening portion and a second lower fastening portion. The second lower fastening portion is provided between the first lower fastening portion and the pump driving shaft.

9 Claims, 10 Drawing Sheets

WATER PUMP MOUNTING STRUCTURE IN INTERNAL COMBUSTION ENGINE

CROSS-REFERENCE TO RELATED APPLICATIONS

The present application claims priority under 35 U.S.C. §119 to Japanese Patent Application No. 2011-252710, filed Nov. 18, 2011, entitled "Water Pump Mounting Structure in Internal Combustion Engine." The contents of this application are incorporated herein by reference in their entirety.

BACKGROUND OF THE INVENTION

1. Field of the Invention

The present disclosure relates to a water pump mounting structure in an internal combustion engine.

2. Discussion of the Background

There have been proposed various structures in which a water pump cover provided with an actuator and configured to rotatably support a pump driving shaft is combined with a water pump housing containing an impeller to form a water pump and in which the water pump is removably mounted on an engine body of an internal combustion engine (see, for example, Japanese Unexamined Patent Application Publication No. 4-012134).

In a structure disclosed in Japanese Unexamined Patent Application Publication No. 4-012134, a power steering pump and a water pump are integrally provided, and are driven by a common pump driving shaft. A water pump housing containing an impeller and a power steering pump housing are combined with a common pump cover being disposed therebetween. A pulley serving as a common actuator is provided at an end of the pump driving shaft protruding from the power steering pump housing.

From an upper portion of the water pump housing of the water pump, a discharging connection pipe that forms a cooling-water discharging passage extending from a pump chamber containing the impeller projects toward the engine body of the internal combustion engine. A mounting bracket is provided in a lower portion of the water pump housing.

The water pump housing is supported by inserting the upper discharging connection pipe in an opening provided in a mounting face on a side wall of the engine body to communicate with a water jacket and fastening the lower mounting bracket to the mounting face of the side wall of the engine body by a fastening bolt.

The power steering pump housing is supported by fastening upper and lower mounting brackets to the mounting face of the side wall of the engine body by fastening bolts.

SUMMARY OF THE INVENTION

According to one aspect of the present invention, a water pump mounting structure includes a water pump cover and a water pump housing. The water pump cover is to rotatably support a pump driving shaft of an actuator. The water pump cover is provided with the actuator. The water pump housing defines a pump chamber to contain an impeller connected to the pump driving shaft. The water pump housing is connected with the water pump cover at a joint face of the water pump housing. The water pump housing includes an upper extending portion and a lower extending portion. The upper extending portion is provided on an upper side of an intermediate pump chamber and extends to an opposite side of the water pump cover with respect to the joint face. The upper extending portion includes an upper mounting face provided to be in contact with a side wall of an engine body of an internal combustion engine when a water pump is mounted on the side wall of the engine body. The upper mounting face is substantially perpendicular to the joint face. The upper extending portion includes a first upper fastening portion and a second upper fastening portion. The first upper fastening portion is to be fastened to the side wall of the engine body with a bolt. The first upper fastening portion is provided at an extension end of the upper extending portion. The second upper fastening portion is to be fastened to the side wall of the engine body with a bolt. The second upper fastening portion is provided between the first upper fastening portion and the pump driving shaft. The lower extending portion is provided on a lower side of the intermediate pump chamber and extends to an opposite side of the water pump cover with respect to the joint face. The lower extending portion includes a lower mounting face provided to be in contact with the side wall of the engine body when the water pump is mounted on the side wall of the engine body. The lower mounting face is substantially perpendicular to the joint face. The lower extending portion includes a first lower fastening portion and a second lower fastening portion. The first lower fastening portion is to be fastened to the side wall of the engine body with a bolt. The first lower fastening portion is provided at an extension end of the lower extending portion. The second lower fastening portion is to be fastened to the side wall of the engine body with a bolt. The second lower fastening portion is provided between the first lower fastening portion and the pump driving shaft.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
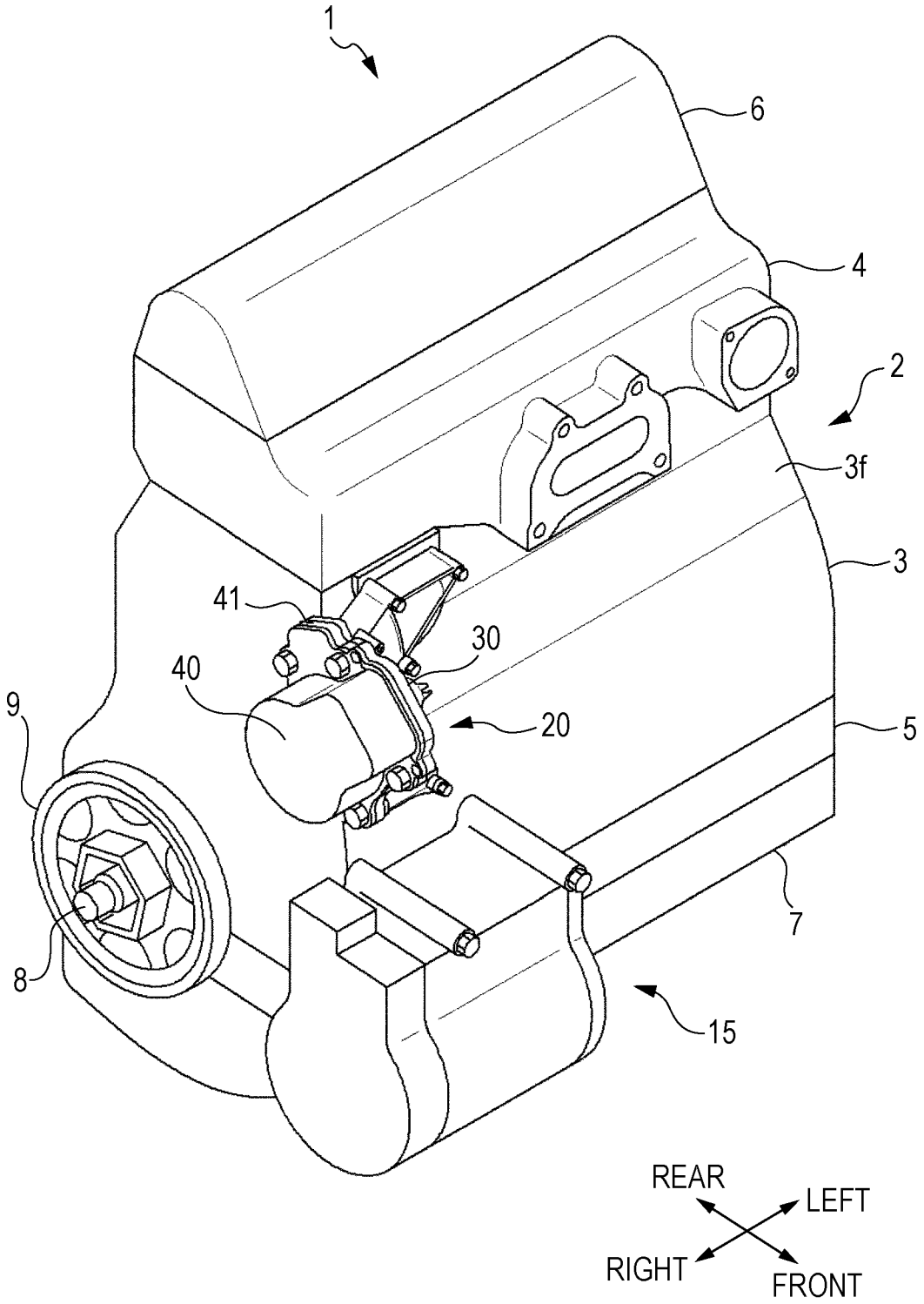
FIG. 1 is an overall perspective view of an internal combustion engine according to an embodiment of the present disclosure.

The embodiments will now be described with reference to the accompanying drawings, wherein like reference numerals designate corresponding or identical elements throughout the various drawings.

The embodiment of the present disclosure will be described below with reference to FIGS. 1 to 11.

Figure 2:
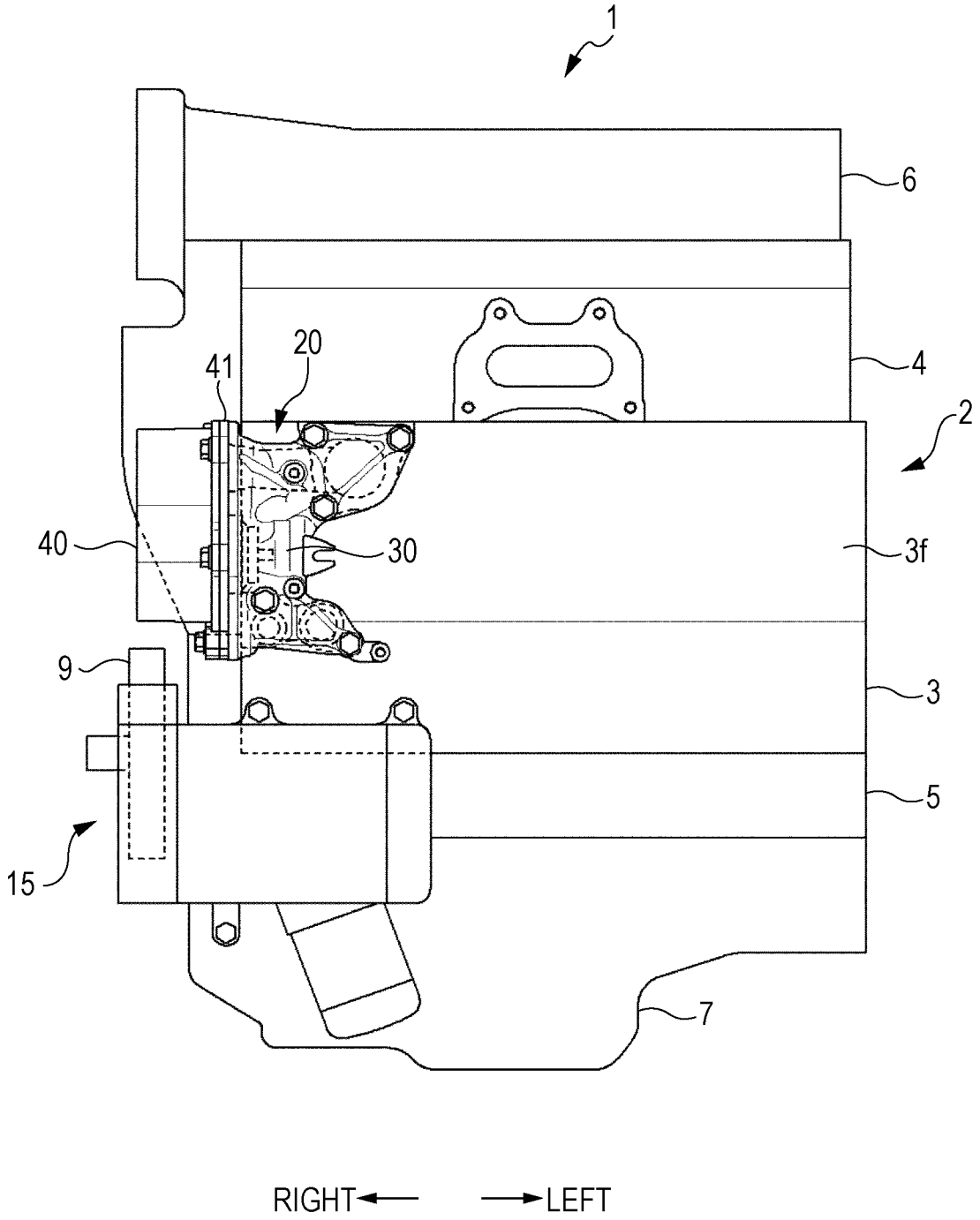
FIG. 2 is a front view of the internal combustion engine.

As illustrated in FIGS. 1 and 2, an internal combustion engine 1 of the embodiment is an in-line four-cylinder and four-stroke water-cooled internal combustion engine. The internal combustion engine 1 is transversely installed in a vehicle with a crankshaft 8 extending in a right-left direction.

In this specification, front, rear, right, and left sides are determined with reference to the vehicle.

In an engine body 2 of the internal combustion engine 1, a lower case 5 is joined to a lower side of a cylinder block 3, in which cylinders are arranged in the right-left direction, in a manner such that the crankshaft 8 is rotatably clamped between the cylinder block 3 and the lower case 5. A cylinder head 4 is provided on the cylinder block 3, and is covered with a cylinder head cover 6. An oil pan 7 is joined to a lower side of the lower case 5.

A flywheel 9 is fitted on an end of the crankshaft 8 projecting rightward from a joint surface between the cylinder block 3 and the lower case 5, in consideration of the weight balance in an axial direction.

An electric water pump 20 is mounted on a right portion of a front side face 3*f* of the cylinder block 3, and an electric compressor 15 is mounted on the lower case 5 below the water pump 20.

Figure 3:
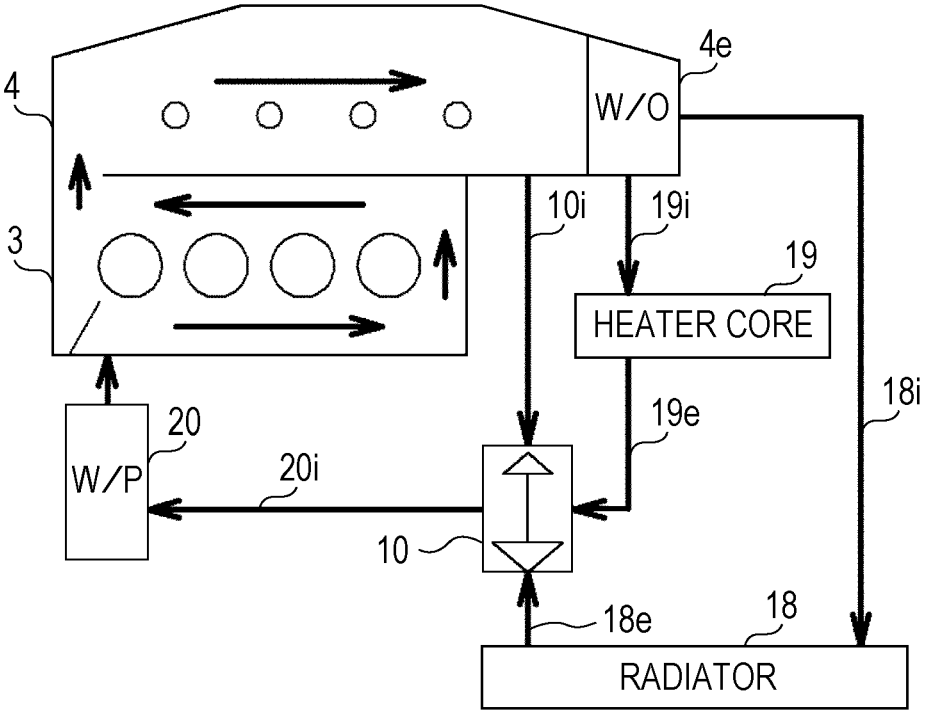
FIG. 3 schematically illustrates a cooling system in the internal combustion engine.

FIG. 3 schematically illustrates a cooling system in which cooling water is circulated by driving of the water pump 20. A main circulation path of the cooling system will be briefly described with reference to FIG. 3.

Cooling water discharged from the water pump 20 first flows into the cylinder block 3, circulates through a water jacket in the cylinder block 3, and flows into the cylinder head 4 on an upper side of the cylinder block 3. Then, the cooling water circulates through a water jacket in the cylinder head 4, exchanges heat with the cylinder block 3 and the cylinder head 4, and flows out from a water outlet 4*e*.

A bypass passage 10*i* extends from the cylinder head 4. Through the bypass passage 10*i*, cooling water directly flows into a thermostat 10 attached to the cylinder head 4.

A radiator inflow passage 18*i* is laid from the water outlet 4*e* to circulate cooling water to a radiator 18, and a radiator outflow passage 18*e* is laid from the radiator 18 to reflux the cooling water to the thermostat 10.

A heater inflow passage 19*i* is also laid from the water outlet 4*e* to supply cooling water to a heater core 19 for air conditioning, and a heater outflow passage 19*e* is laid from the heater core 19 to reflux the cooing water to the thermostat 10.

From the thermostat 10, a water-pump suction passage 20*i* is laid to reflux the cooling water to the water pump 20.

The main circulation path of the cooling system has the above-described configuration.

In a cold state, the thermostat 10 closes the radiator outflow passage 18*e* and opens the bypass passage 10*i*. Thus, cooling water flows in the cylinder block 3 and the cylinder head 4 without circulating in the radiator 18, thereby promoting a warm-up.

In a hot state, the thermostat 10 opens the radiator outflow passage 18*e* and closes the bypass passage 10*i*. Thus, cooling water, whose heat is removed through circulation in the radiator 18, flows in the cylinder block 3 and the cylinder head 4, thereby cooling the cylinder block 3 and the cylinder head 4.

Cooling water flowing in the heater core 19 is refluxed from the heater core 19 to the water pump 20 via the thermostat 10. The cooling water is sucked by the water pump 20 and constantly circulates, regardless of whether or not the thermostat 10 is driven and with little influence on wax in the thermostat 10.

A structure for mounting the water pump 20 on the cylinder block 3 will be described below.

The cylinder block 3 is long in the cylinder arrangement direction (right-left direction), and a portion of the cylinder block 3 corresponding to a crankcase in a lower half bulges in the front-rear direction to increase in width (see FIG. 1).

Figure 5:
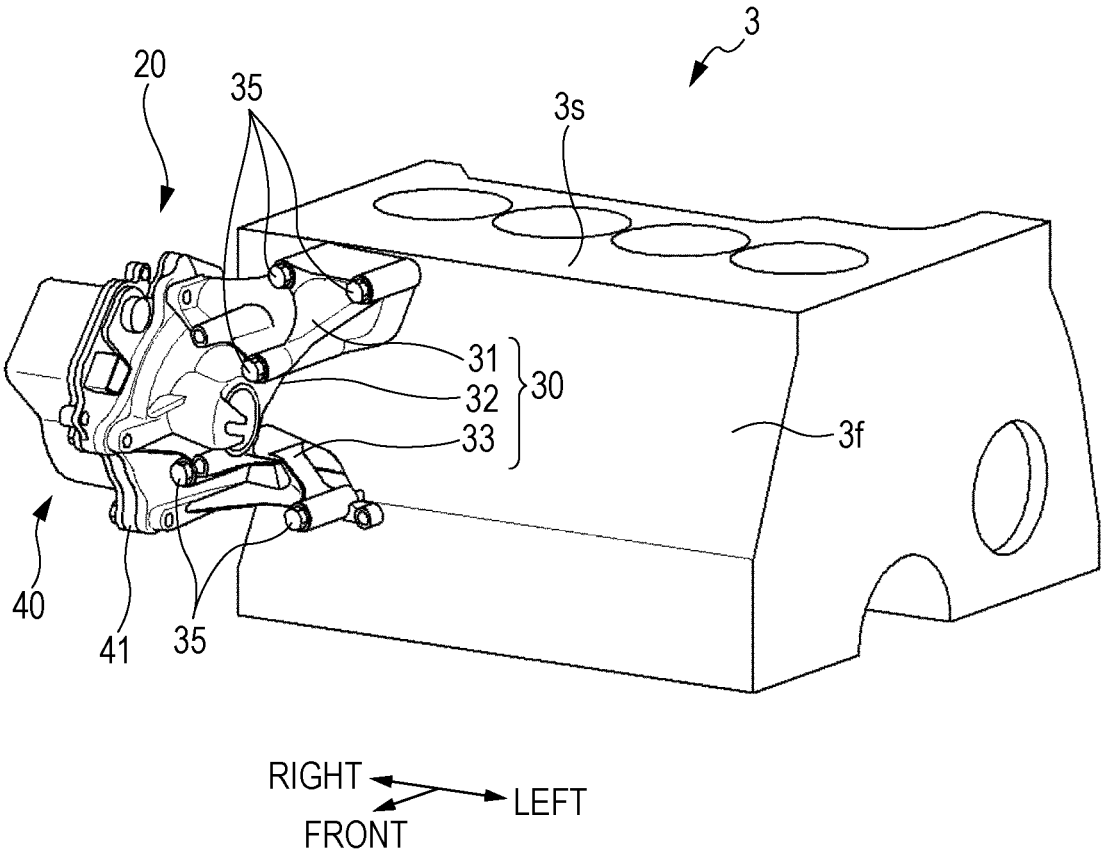
FIG. 5 is a perspective view illustrating a state in which a water pump is mounted on the cylinder block.

As illustrated in FIG. 5, the electric water pump 20 is mounted on the right portion of the front side face 3*f* of the cylinder block 3.

Figure 4:
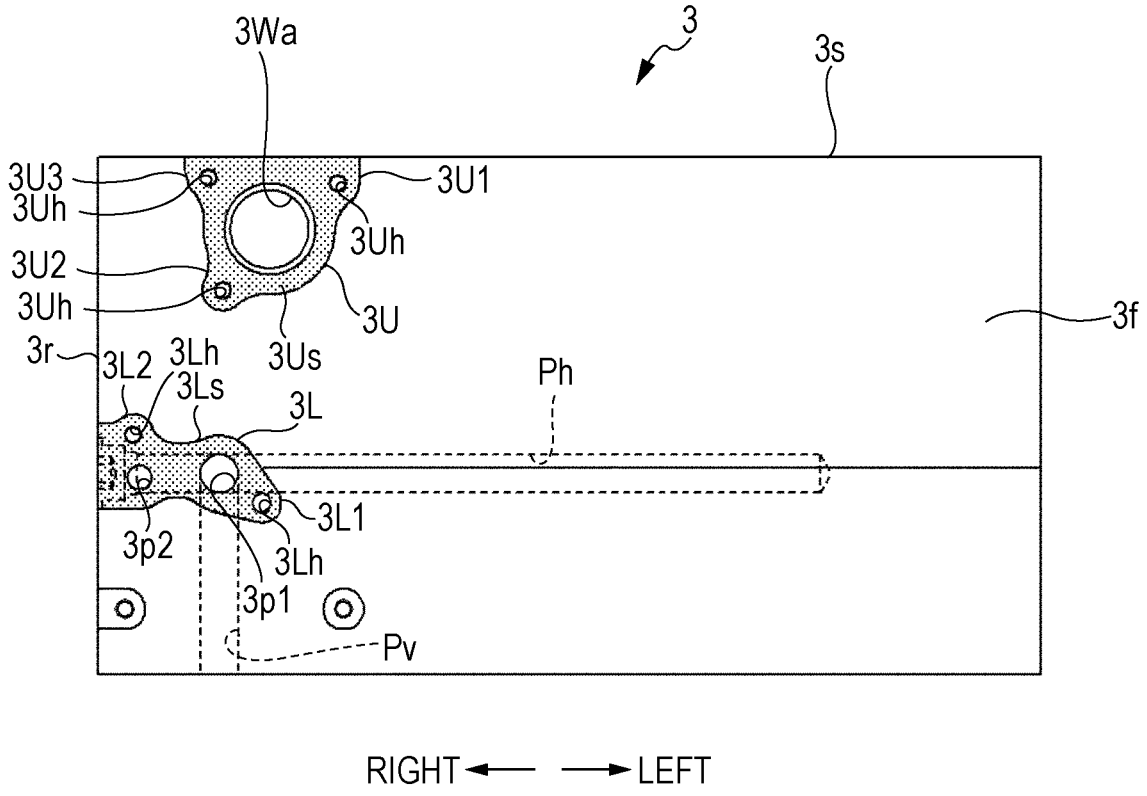
FIG. 4 is a front view of a cylinder block.

As illustrated in FIG. 4, a cooling-water inlet 3Wa is open in an upper right portion of the front side face 3*f* of the cylinder block 3. A portion around the cooling-water inlet 3Wa slightly extends frontward along a joint surface 3*s* between the cylinder block 3 and the cylinder head 4 to form an upper mounting portion 3U having, as an open end face, a vertical flat mounting face 3Us.

The upper mounting portion 3U around the cooling-water inlet 3Wa includes a first upper mounting boss portion 3U1 provided along the joint surface 3*s* on an upper left side of the cooling-water inlet 3Wa, a second upper mounting boss portion 3U2 provided on a lower right side of the cooling-water inlet 3Wa, and a third upper mounting boss portion 3U3 provided along the joint surface 3*s* on an upper right side of the cooling-water inlet 3Wa. Each of the first, second, and third upper mounting boss portions 3U1, 3U2, and 3U3 has a mounting hole 3Uh.

The front side face 3*f* of the cylinder block 3 also has oil passage openings 3*p*1 and 3*p*2 arranged in the right-left direction near a right side face 3*r* and on a slightly lower side of the center. A portion around the oil passage openings 3*p*1 and 3*p*2 slightly extends frontward to form a lower mounting portion 3L having, as an open end face, a vertical flat mounting face 3Ls.

The lower mounting portion 3L extends long leftward from the right side face 3*r* of the cylinder block 3. The lower mounting portion 3L is located below the upper mounting portion 3U and at a position slightly shifted rightward from the upper mounting portion 3U, and slightly protrudes frontward from the upper mounting portion 3U.

The cylinder block 3 includes oil passages of a lubricating system. The oil passage openings 3*p*1 and 3*p*2 communicate with an oil passage Ph extending in the right-left direction, and the oil passage opening 3*p*1 communicates with an oil passage Pv extending in the vertical direction (see FIG. 4).

The lower mounting portion 3L around the oil passage openings 3*p*1 and 3*p*2 includes a first lower mounting boss portion 3L1 provided on a lower left side of the left oil passage opening 3*p*1, and a second lower mounting boss portion 3L2 provided on an upper and slightly right side of the right oil passage opening 3*p*2. Each of the first and second lower mounting boss portions 3L1 and 3L2 has a mounting hole 3Lh.

The first and second lower mounting boss portions 3L1 and 3L2 are provided on opposite sides of the oil passage openings 3*p*1 and 3*p*2.

The water pump 20 to be mounted on the front side face 3*f* of the cylinder block 3 includes a water pump housing 30, and an electric motor 40 serving as a driving source. A water pump cover 41 is incorporated in the electric motor 40.

In a state in which the electric motor 40 is integrally attached to the water pump housing 30 with the water pump cover 41 being put on a joint face 30*a* on the right side of the water pump housing 30, the water pump housing 30 is attached such that mounting faces 31Us and 33Ls substantially perpendicular to the joint face 30*a* of the water pump housing 30 are in contact with the front side face 3*f* of the cylinder block 3.

In the water pump housing 30, an upper extending portion 31 and a lower extending portion 33 are provided on upper and lower sides of an intermediate pump chamber portion 32, respectively. The upper extending portion 31 and the lower extending portion 33 extend to a side of the joint face 30*a* with the water pump cover 41 opposite the water pump cover (see FIGS. 6 and 7).

Figure 6:
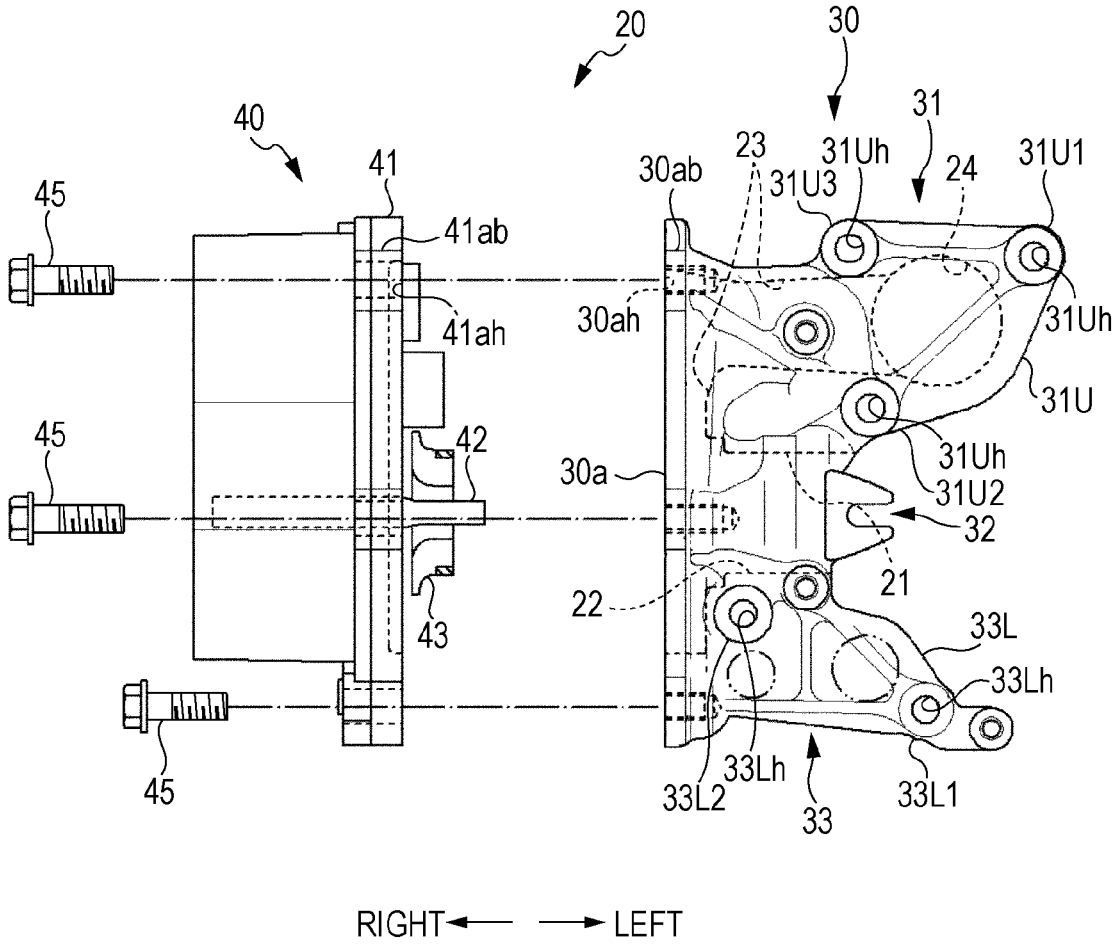
FIG. 6 is an exploded front view of the water pump.

Therefore, the water pump housing 30 is shaped such that its left side is constricted at the intermediate pump chamber portion 32, in front view (FIG. 6).

Figure 8:
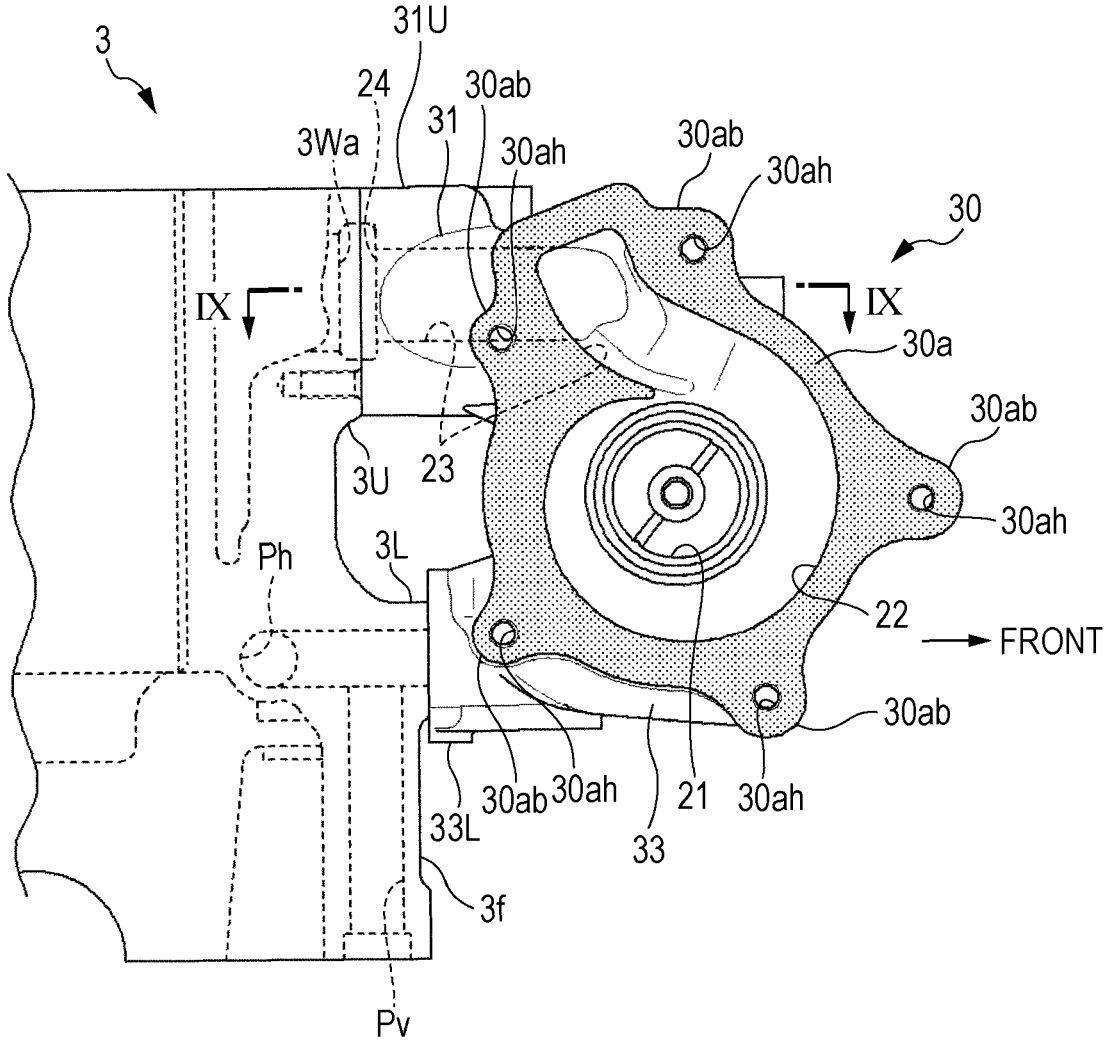
FIG. 8 is a right side view illustrating a state in which the water pump housing is attached to the cylinder block.
Figure 9:
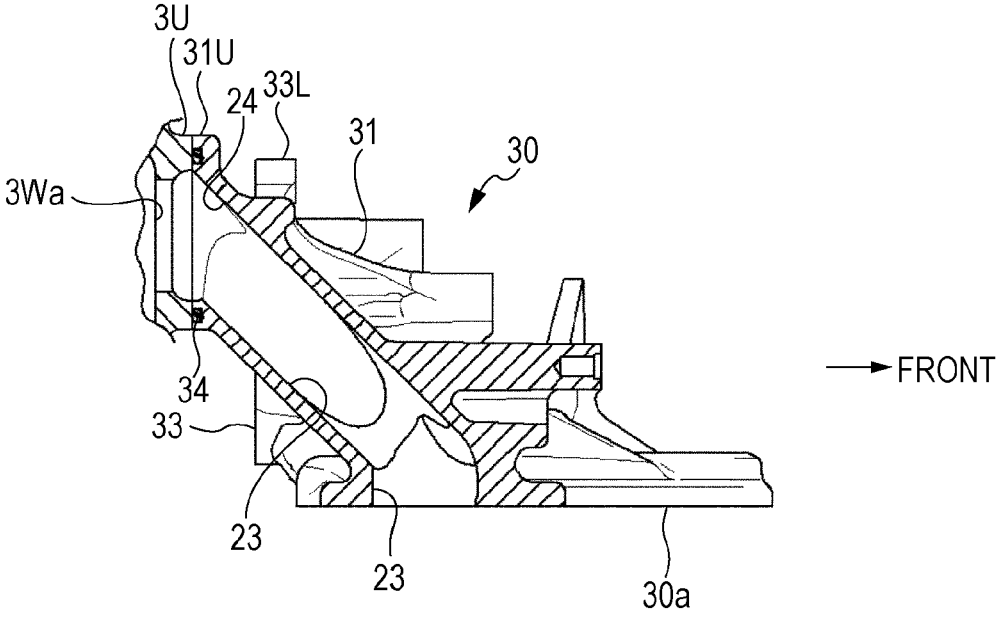
FIG. 9 is a cross-sectional view, taken along line IX-IX of FIGS. 7 and 8.

In the intermediate pump chamber portion 32 of the water pump housing 30, a pump chamber 22 is open in the joint face 30*a* (see FIG. 8). From the pump chamber 22, an upstream cooling-water passage 21 extends through to a side opposite the joint face 30*a* (left side) to reach the left side face.

Along the joint face 30*a* of the water pump housing 30, a downstream cooling-water passage 23 extends upward as a groove from the pump chamber 22 (see FIG. 8).

The downstream cooling-water passage 23 is bent short of an upper end of the joint face 30*a*, extends in an extending direction of the upper extending portion 31 (leftward), and reaches a cooling-water communicating portion 24 provided in an upper fastening base portion 31U at an extension end of the upper extending portion 31 (see FIGS. 6 to 9).

Referring to FIG. 8, the pump chamber 22 and the groove of the downstream cooling-water passage 23 are open in the joint face 30*a* of the water pump housing 30. On the periphery of the joint face 30*a*, five cover fastening portions 30*ab* are provided with fastening holes 30*ah*.

To the joint face 30*a* of the water pump housing 30, the water pump cover 41 is attached together with the electric motor 40.

Figure 10:
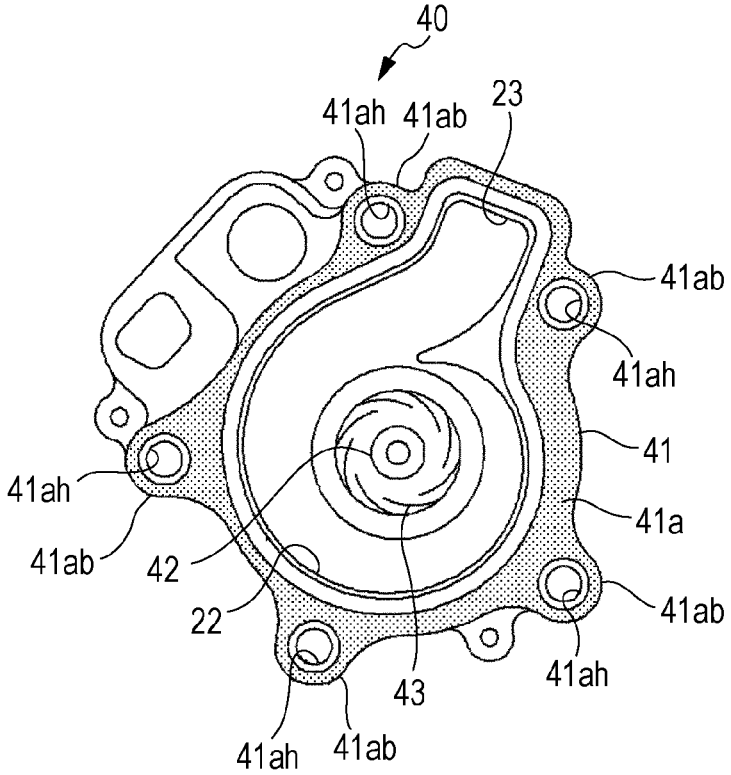
FIG. 10 is a left side view of an electric motor incorporated in a water pump cover.

As illustrated in FIG. 10, the water pump cover 41 includes a joint face 41*a* to oppose the joint face 30*a* of the water pump housing 30 and having almost the same shape as that of the joint face 30*a*. A large part of the pump chamber 22 is provided in a middle portion, and a part of the downstream cooling-water passage 23 extends upward from the pump chamber 22.

On the periphery of the joint face 41*a*, attachment portions 41*ab*, each having an attachment hole 41*ah*, are provided in correspondence to the five cover fastening portions 30*ab* of the water pump housing 30.

The joint face 41*a* of the water pump cover 41 also has a groove in which a seal member is to be fitted.

A pump driving shaft 42 serving as a driving shaft of the electric motor 40 protrudes through the center of a bottom wall of the pump chamber 22 in the water pump cover 41. An impeller 43 is fitted on a protruding end of the pump driving shaft 42.

The water pump cover 41 is combined with the water pump housing 30 and the electric motor 40 is attached by passing attachment bolts 45 through the attachment holes 41*ah* and screwing the attachment bolts 45 in the fastening holes 30*ah* of the water pump housing 30 in a state in which the joint face 30*a* of the water pump housing 30 is in contact with the joint face 41*a* of the water pump cover 41 incorporated in the electric motor 40.

When the water pump housing 30 and the water pump cover 41 are combined, the pump chamber 22 and the downstream cooling-water passage 23 are defined. The impeller 43 fitted on the end of the pump driving shaft 42 protruding from the electric motor 40 is located in the pump chamber 22.

Therefore, when the electric motor 40 is driven and the pump driving shaft 42 is rotated together with the impeller 43, cooling water flowing in the upstream cooling-water passage 21 is sucked into the pump chamber 22, and is discharged to the downstream cooling-water passage 23.

The water pump 20, in which the electric motor 40 is thus attached to the water pump housing 30 together with the water pump cover 41, is mounted on the mounting face 3Us of the upper mounting portion 3U and the mounting face 3Ls of the lower mounting portion 3L provided on the front side face 3*f* of the cylinder block 3.

A mounting face 31Us in which the cooling-water communicating portion 24 is open is provided on a surface of the upper fastening base portion 31U at the extension end of the upper extending portion 31 in the water pump housing 30. The attachment face 31Us faces the mounting face 3Us of the upper mounting portion 3U of the cylinder block 3 (see FIG. 7).

In the mounting face 31Us, a groove 31*v* in which a seal member 34 (see FIG. 9) is to be fitted is provided around the opening of the cooling-water communicating portion 24.

Figure 11:
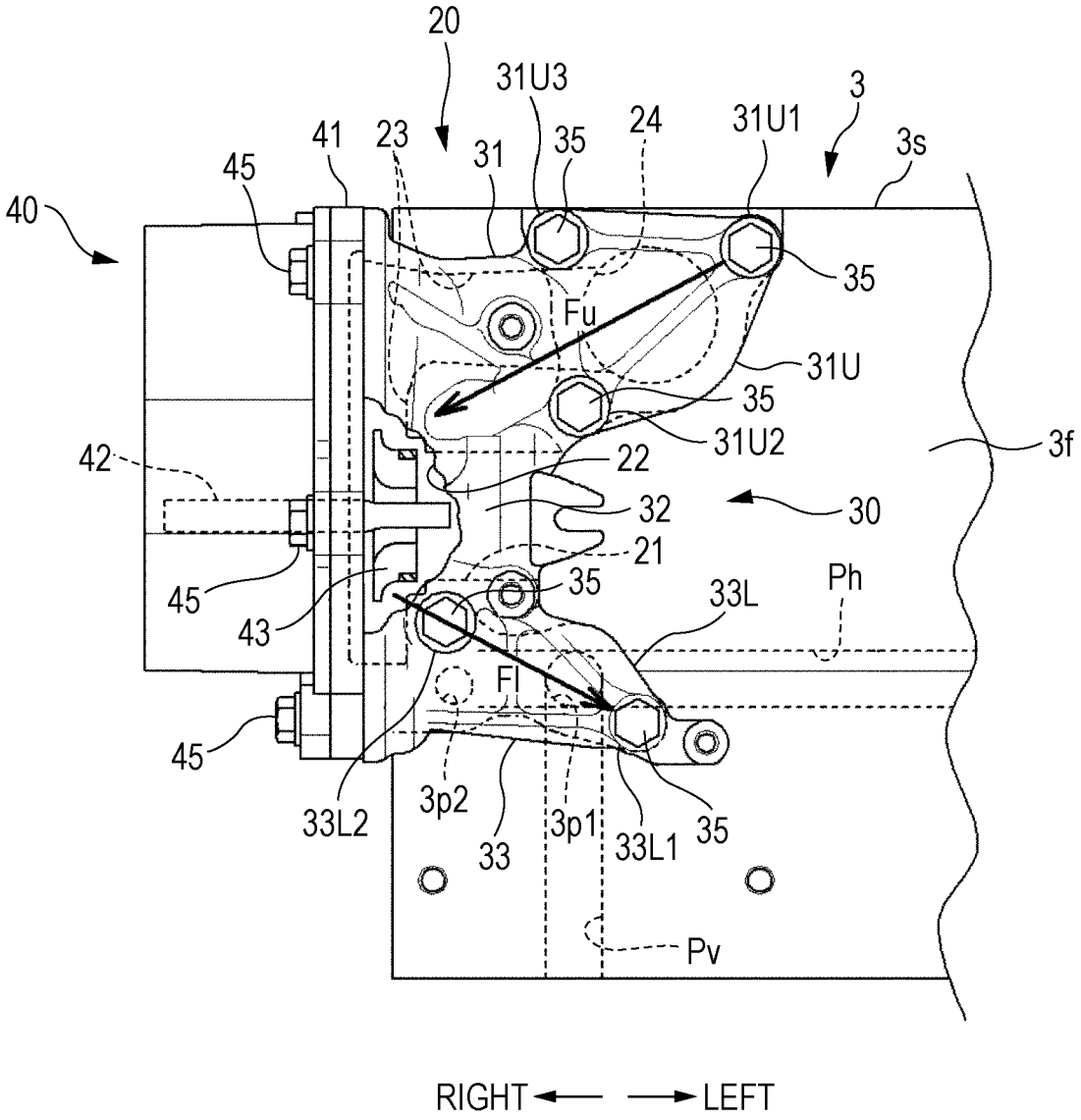
FIG. 11 is a front view illustrating a state in which the water pump is mounted on the cylinder block.

The upper fastening base portion 31U at the extension end of the upper extending portion 31 includes a first upper fastening portion 31U1 at an extension end farthest from the joint face 30*a*, a second upper fastening portion 31U2 provided between the first upper fastening portion 31U1 and the pump driving shaft 42, and a third upper fastening portion 31U3 provided on a right side of the first upper fastening portion 31U1 closer to the right pump driving shaft 42 and above the second upper fastening portion 31U2 (see FIG. 11).

Figure 7:
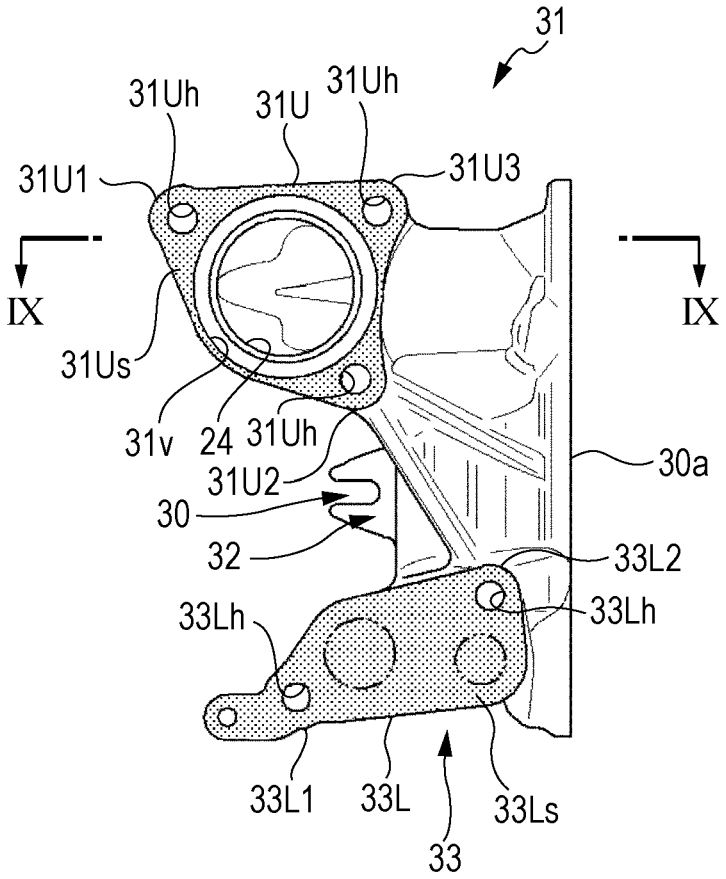
FIG. 7 is a rear view of a water pump housing.

The first upper fastening portion 31U1, the second upper fastening portion 31U2, and the third upper fastening portion 31U3 in the upper fastening base portion 31U are provided on the periphery of the mounting face 31Us serving as the open end face of the cooling-water communicating portion 24, and the attachment holes 31Uh thereof are open in the mounting face 31Us (see FIG. 7).

As illustrated in FIG. 7, the second upper fastening portion 31U2 and the third upper fastening portion 31U3 are located on lower and upper sides, respectively, of the downstream cooling-water passage 23 that extends from the pump chamber 22 toward the cooling-water communicating portion 24 in the first upper fastening portion 31U1.

Referring to FIGS. 4 and 7, the mounting face 31Us of the upper fastening base portion 31U of the water pump housing 30 faces the mounting face 3Us of the upper mounting portion 3U provided on the front side face 3*f* of the cylinder block 3. The aperture of the cooling-water communicating portion 24 of the water pump housing 30 opposes the cooling-water inlet 3Wa of the cylinder block 3. The first upper fastening portion 31U1, the second upper fastening portion 31U2, and the third upper fastening portion 31U3 on the periphery of the mounting face 31Us of the water pump housing 30 correspond to the first upper mounting boss portion 3U1, the second upper mounting boss portion 3U2, and the third upper mounting boss portion 3U3 on the periphery of the mounting face 3Us of the cylinder block 3, respectively.

A lower fastening base portion 33L at an extension end of the lower extending portion 33 in the water pump housing 30 corresponds to the lower mounting portion 3L on the front side face 3*f* of the cylinder block 3. A mounting face 33Ls having the same shape as that of the mounting face 3Ls of the lower mounting portion 3L faces the mounting face 3Ls.

The lower fastening base portion 33L at the extension end of the lower extending portion 33 includes a first lower fastening portion 33L1 at an extension end farthest from the joint face 30*a*, and a second lower fastening portion 33L2 provided between the first lower fastening portion 33L1 and the pump driving shaft 42 (see FIG. 11).

The first lower fastening portion 33L1 and the second lower fastening portion 33L2 in the lower fastening base portion 33L each have a mounting hole 33Lh in the mounting face 33Ls (see FIG. 7).

Referring to FIGS. 4 and 7, the mounting face 33Ls of the lower fastening base portion 33L in the water pump housing 30 faces the mounting face 3Ls of the lower mounting portion 3L provided on the front side face 3*f* of the cylinder block 3, and the first lower fastening portion 33L1 and the second lower fastening portion 33L2 on the right and left sides of the mounting face 33Ls in the water pump housing 30 correspond to the first lower mounting boss portion 3L1 and the second lower mounting boss portion 3L2 of the mounting face 3Ls in the cylinder block 3, respectively.

Therefore, to mount the water pump 20 on the front side face 3*f* of the cylinder block 3, the mounting face 31Us of the upper fastening base portion 31U of the upper extending portion 31 and the mounting face 33Ls of the lower fastening base portion 33L of the lower extending portion 33 in the water pump housing 30 are brought into contact with the mounting face 3Us of the upper mounting portion 3U and the mounting face 3Ls of the lower mounting portion 3L provided on the front side face 3*f* of the cylinder block 3, and mounting bolts 35 are passed through the mounting holes 31Uh of the first, second, and third upper fastening portions 31U1, 31U2, and 31U3 of the upper fastening base portion 31U and the mounting holes 33Lh of the first and second lower fastening portions 33L1 and 33L2 of the lower fastening base portion 33L in the water pump housing 30, and are screwed in and fastened to the mounting holes 3Uh of the first, second, and third upper mounting boss portions 3U1, 3U2, and 3U3 of the upper mounting portion 3U and the mounting holes 3Lh of the first and second lower mounting boss portions 3L1 and 3L2 of the lower mounting portion 3L in the cylinder block 3.

FIG. 11 illustrates a state in which the water pump 20 is supported with the water pump housing 30 being mounted on the front side face 3*f* of the cylinder block 3.

Since the mounting face 31Us of the upper fastening base portion 31U in the water pump housing 30 is joined to the mounting face 3Us of the upper mounting portion 3U in the cylinder block 3, the cooling-water communicating portion 24 in the water pump housing 30 communicates with the cooling-water inlet 3Wa of the cylinder block 3 while being sealed around its aperture by a seal member 34.

Further, since the mounting face 33Ls of the lower fastening base portion 33L in the water pump housing 30 is joined to the mounting face 3Ls of the lower mounting portion 3L in the cylinder block 3, the oil passage openings 3*p*1 and 3*p*2 of the cylinder block 3 are closed.

The water-pump suction passage 20*i*, in which cooling water refluxed from the thermostat 10 flows, is connected to the upstream cooling-water passage 21 extending to the left side face of the intermediate pump chamber portion 32 in the water pump housing 30. Hence, when the water pump 20 is driven by the electric motor 40, the cooling water refluxed from the thermostat 10 to the upstream cooling-water passage 21 is sucked into the pump chamber 22, and is discharged to the downstream cooling-water passage 23. Then, the cooling water flows from the cooling-water communicating portion 24 into the cooling-water inlet 3Wa of the cylinder block 3, and circulates in the water jackets of the cylinder block 3 and the cylinder head 4.

Referring to FIG. 11, in the water pump housing 30, the upper fastening base portion 31U of the upper extending portion 31 is fastened to the front side face 3*f* of the cylinder block 3 at the first, second, and third upper fastening portions 31U1, 31U2, and 31U3, and the lower fastening base portion 33L of the lower extending portion 33 is fastened to the front side face 3*f* of the cylinder block 3 at the first and second lower fastening portions 33L1 and 33L2.

The water pump housing 30 thus mounted on the front side face 3*f* of the cylinder block 3 supports the electric motor 40 combined with the right joint face 30*a* in a cantilevered manner.

The electric motor 40 is a heavy member in which a coil, a magnet, etc. are provided around the pump driving shaft 42. The center of gravity of the electric motor 40 is substantially located at the pump driving shaft 42.

Assuming a force Fu acting on the first upper fastening portion 31U1 at the extension end of the upper extending portion 31 and a force Fl acting on the first lower fastening portion 33L1 at the extension end of the lower extending portion 33 in the water pump housing 30 that supports the heavy electric motor 40 on the right side in a cantilevered manner, as shown by arrows of FIG. 11, the force Fu acting on the first upper fastening portion 31U1 travels from the first upper fastening portion 31U1 to the pump driving shaft 42, and the force Fl acting on the first lower fastening portion 33L1 travels from the pump driving shaft 42 to the first lower fastening portion 33L1.

The second upper fastening portion 31U2 of the upper extending portion 31 is provided between the first upper fastening portion 31U1 and the pump driving shaft 42 and is substantially located along the direction of the force Fu acting on the first upper fastening portion 31U1. The force Fu acting on the first upper fastening portion 31U1 can be efficiently shared and supported by the second upper fastening portion 31U2 substantially located along the direction of the force Fu.

In the embodiment, the third upper fastening portion 31U3 is provided on an upper side of the downstream cooling-water passage 23, which extends from the pump chamber 22 toward the first upper fastening portion 31U1, opposite the second upper fastening portion 31U2. The third upper fastening portion 31U3 is also substantially provided between the first upper fastening portion 31U1 and the pump driving shaft 42 and is located at a position to support the force Fu acting on the first upper fastening portion 31U1 in the up-down direction in cooperation with the second upper fastening portion 31U2. Hence, the third upper fastening portion 31U3 can efficiently share and support the force Fu acting on the first upper fastening portion 31U1 in cooperation with the second upper fastening portion 31U2.

Also, the second lower fastening portion 33L2 of the lower extending portion 33 is provided between the first lower fastening portion 33L1 and the pump driving shaft 42, and is located in the direction of the force Fl acting on the first lower fastening portion 33L1. The force Fl acting on the first lower fastening portion 33L1 can be efficiently shared and supported by the second lower fastening portion 33L2 substantially located along the direction of the force Fl.

As described above, the water pump housing 30 is firmly fixed to the cylinder block 3 by the mounting structure such that the weight of the electric motor 40 on the right side of the water pump cover 41 does not concentrate at a certain fixing portion, but is efficiently shared and supported by the three upper fixing portions 31U1, 31U2, and 31U3 and the two lower fixing portions 33L1 and 33L2.

Even when the electric motor 40 is considerably heavy, the water pump housing 30 is mounted on the engine body such that the weight of the water pump cover 41 provided with the electric motor 40 is evenly and efficiently supported by the upper and lower fastening portions 31U1, 31U2, 31U3, 33L1, and 33L2. Therefore, the water pump housing 30 is rarely displaced, and high assembly performance can be ensured.

In the water pump housing 30, the second lower fastening portion 33L2 closest to the electric motor 40 is located at a position to support the weight of the heavy electric motor 40 on its right side and the weights of most parts of the upper extending portion 31 and the lower extending portion 33 on its left side in a well balanced manner.

Accordingly, when the water pump housing 30 of the water pump 20 is mounted on the front side face 3*f* of the cylinder block 3, first, the second lower fastening portion 33L2 closest to the electric motor 40 is fastened to the second lower mounting boss portion 3L2 of the cylinder block 3 by the mounting bolt 35. This allows the water pump 20 to be temporarily attached in a balanced manner, and achieves efficient mounting.

In the water pump housing 30, the upper extending portion 31 is fastened to the cylinder block 3 at the first, second, and third upper fastening portions 31U1, 31U2, and 31U3, and the lower extending portion 33 is fastened to the cylinder block 3 at the first and second lower fastening portions 33L1 and 33L2. Hence, the upper fastening base portion 31U of the upper extending portion 31 and the lower fastening base portion 33L of the lower extending portion 33 are independently and firmly fastened.

For this reason, the mounting face 33Ls of the lower fastening base portion 33L and the mounting face 3Us of the cylinder block 3 are joined with a strong fastening force at the first, second, and third upper fastening portions 31U1, 31U2, and 31U3 provided around the aperture of the cooling-water communicating portion 24. This maintains high sealability for the connecting portion to the cooling-water passage.

Since the mounting face 33Ls of the lower fastening base portion 33L in the lower extending portion 33 of the water pump housing 30 closes the oil passage openings 3*p*1 and 3*p*2 communicating with the oil passage Ph, a component only for sealing, such as a seal plug, is unnecessary. This reduces the number of components and enhances assembly operability.

In addition, the first lower fastening portion 33L1 and the second lower fastening portion 33L2 of the lower extending portion 33 provided on opposite sides of the oil passage openings 3*p*1 and 3*p*2 of the oil passage Ph are fastened to the cylinder block 3. Hence, the oil passage openings 3*p*1 and 3*p*2 of the oil passage Ph can be closed with high sealability.

In the embodiment, the lower fastening base portion 33L of the lower extending portion 33 in the water pump housing 30 closes the oil passage openings 3*p*1 and 3*p*2 communicating with the oil passage Ph. Alternatively, when a portion of the lower fastening base portion 33L opposing the oil passage openings 3*p*1 and 3*p*2 is bored to cut off communication between the oil passage openings 3*p*1 and 3*p*2, it is possible to easily form an oil circulation path in which oil is taken out of the oil passage opening 3*p*1, is supplied to a component such as an oil cooler, and is returned to the oil passage opening 3*p*2.

While the actuator for driving the pump driving shaft 42 of the water pump 20 is formed by the electric motor 40 in the embodiment, the present disclosure is also applicable to a water pump in which a pump driving shaft is driven by an actuator formed by a pulley that is rotated with a rotating endless belt being wound therearound.

A water pump mounting structure according to an aspect of the embodiment removably mounts a water pump (20) on an engine body (2) of an internal combustion engine. The water pump (20) includes a water pump cover (41) provided with an actuator (40) and configured to rotatably support a pump driving shaft (42), and a water pump housing (30) configured to form a pump chamber (22) containing an impeller (43) and combined with the water pump cover (41) at a joint face (30*a*). The water pump housing (30) includes an upper extending portion (31) and a lower extending portion (33) provided on upper and lower sides of an intermediate pump chamber (32) and extending to a side of the joint face (30*a*) opposite the water pump cover (41). The upper extending portion (31) and the lower extending portion (33) include mounting faces (31Us, 33Ls) to be mounted on a side wall (3*f*) of the engine body (2) substantially perpendicular to the joint face (30*a*). The upper extending portion (31) includes a first upper fastening portion (31U1) provided at an extension end, and a second upper fastening portion (31U2) provided between the first upper fastening portion (31U1) and the pump driving shaft (42). The lower extending portion (33) includes a first lower fastening portion (33L1) provided at an extension end, and a second lower fastening portion (33L2) provided between the first lower fastening portion (33L1) and the pump driving shaft (42). The water pump (20) is mounted on the side wall (3*f*) of the engine body (2) while the mounting faces (31Us, 31Ls) of the water pump housing (30) are in contact with the side wall (3*f*) of the engine body (2) and the first upper fastening portion (31U1), the second upper fastening portion (31U2), the first lower fastening portion (33L1), and the second lower fastening portion (33L2) are fastened by bolts (35).

In this aspect of the embodiment, even when the water pump cover (41) is increased in weight by the actuator (40), a force acting on the first upper fastening portion (31U1) and traveling toward the pump driving shaft (42) is efficiently shared and supported by the second upper fastening portion (31U2) substantially located along a direction of the force, and a force acting on the first lower fastening portion (33L1) from the pump driving shaft (42) is efficiently shared and supported by the second lower fastening portion (33L2) substantially located along a direction of the force. Thus, the forces are dispersed without concentrating at any of the fastening portions, and the entire water pump housing (30) is firmly fixed to the engine body (2) with the mounting structure that efficiently supports the weight of the water pump cover (41).

Even when the actuator (40) of the embodiment is considerably heavy, the water pump housing (30) is mounted on the engine body (2) such that the weight of the water pump cover (41) with the actuator (40) is evenly and efficiently supported by a plurality of upper and lower fastening portions. Hence, the water pump housing (30) of the embodiment is rarely displaced, and ensures high assembly performance.

The upper extending portion (31) of the water pump housing (30) is fastened to the engine body (2) at the first and second upper fastening portions (31U1, 31U2), and the lower extending portion (33) is fastened to the engine body (2) at the first and second lower fastening portions (33L1, 33L2). Hence, the upper extending portion (31) and the lower extending portion (33) of the embodiment are independently fastened firmly. This maintains high sealability at a connecting portion to a cooling-water discharging passage (downstream cooling-water passage) provided in the mounting face (31Us) of the upper extending portion (31).

Preferably, the upper extending portion (31) of the embodiment includes a downstream cooling-water passage (23) extending from the pump chamber (22) of the water pump housing (30) toward the first upper fastening portion (31U1), and reaching a cooling-water communicating portion (24) opening in the mounting face (31Us) at a position short of the first upper fastening portion (31U1) to pass cooling water to a cooling-water inlet (3Wa) of the engine body (2). A third upper fastening portion (31U3) of the embodiment is provided around the cooling-water communicating portion (24) together with the first upper fastening portion (31U1) and the second upper fastening portion (31U2) such that the third upper fastening portion (31U3) and the second upper fastening portion (31U2) are located on upper and lower sides of the downstream cooling-water passage (23), and is fastened to the side wall (3*f*) of the engine body (2) by a bolt together with the first upper fastening portion (31U1) and the second upper fastening portion (31U2).

In this aspect of the embodiment, a portion of the mounting face (31Us) of the upper extending portion (31) around the cooling-water communicating portion (24) at the end of the cooling-water passage can be firmly fastened to the engine body (2) at the first, second, and third upper fastening portions (31U1, 31U2, 31U3). This easily seals the aperture of the cooling-water communicating portion (24) serving as the connecting portion to the cooling-water passage.

Further, the third upper fastening portion (31U3) is provided between the pump driving shaft (42) and the first upper fastening portion (31U1). Thus, the third upper fastening portion (31U3) of the embodiment can efficiently share and support the force acting on the first upper fastening portion (31U1) and traveling toward the pump driving shaft (42) in cooperation with the second upper fastening portion (31U2).

Preferably, the first lower fastening portion (33L1) and the second lower fastening portion (33L2) of the lower extending portion (33) are located on opposite sides of an oil passage opening (3*p*1, 3*p*2) of an oil passage (Ph) provided in the engine body (2), and the mounting face (33Ls) of the lower extending portion (33) closes the oil passage opening (3*p*1, 3*p*2).

In this aspect of the embodiment, a component, such as a seal plug, only for sealing the oil passage opening of the oil passage is unnecessary. This reduces the number of components and enhances assembly operability.

Further, the oil passage (3*p*1, 3*p*2) of the embodiment can be closed with high sealability.

Obviously, numerous modifications and variations of the present invention are possible in light of the above teachings. It is therefore to be understood that within the scope of the appended claims, the invention may be practiced otherwise than as specifically described herein.

What is claimed is:

1. A water pump mounting structure comprising:

a water pump cover to rotatably support a pump driving shaft of an actuator, the water pump cover being provided with the actuator; and a water pump housing defining a pump chamber to contain an impeller connected to the pump driving shaft, the water pump housing being connected with the water pump cover at a joint face of the water pump housing, the water pump housing comprising:

an upper extending portion provided on an upper side of an intermediate pump chamber and extending to an opposite side of the water pump cover with respect to the joint face, the upper extending portion including an upper mounting face provided to be in contact with a side wall of an engine body of an internal combustion engine when a water pump is mounted on the side wall of the engine body, the upper mounting face being substantially perpendicular to the joint face, the upper extending portion comprising:

a first upper fastening portion to be fastened to the side wall of the engine body with a bolt, the first upper fastening portion being provided at an extension end of the upper extending portion; and a second upper fastening portion to be fastened to the side wall of the engine body with a bolt, the second upper fastening portion being provided between the first upper fastening portion and the pump driving shaft; and a lower extending portion provided on a lower side of the intermediate pump chamber and extending to an opposite side of the water pump cover with respect to the joint face, the lower extending portion including a lower mounting face provided to be in contact with the side wall of the engine body when the water pump is mounted on the side wall of the engine body, the lower mounting face being substantially perpendicular to the joint face, the lower extending portion comprising:

a first lower fastening portion to be fastened to the side wall of the engine body with a bolt, the first lower fastening portion being provided at an extension end of the lower extending portion; and a second lower fastening portion to be fastened to the side wall of the engine body with a bolt, the second lower fastening portion being provided linearly between the first lower fastening portion and the pump driving shaft, wherein the second upper fastening portion and the second lower fastening portion are respectively disposed closer to the pump driving shaft than the first upper fastening portion and the first lower fastening portion both in a right-left direction and in an up-down direction when viewed in a front-rear direction.

2. The water pump mounting structure according to claim 1, wherein the upper extending portion includes a downstream cooling-water passage extending from the pump chamber of the water pump housing toward the first upper fastening portion, and reaching a cooling-water communicating portion opening through which cooling water is to pass to a cooling-water inlet of the engine body, the cooling-water communicating portion opening being provided in the upper mounting face at a position short of the first upper fastening portion, and wherein the upper extending portion further comprises a third upper fastening portion to be fastened to the side wall of the engine body with a bolt together with the first upper fastening portion and the second upper fastening portion, the third upper fastening portion being provided around the cooling-water communicating portion together with the first upper fastening portion and the second upper fastening portion such that the third upper fastening portion and the second upper fastening portion are respectively located on upper and lower sides of the downstream cooling-water passage.

3. The water pump mounting structure according to claim 2, wherein the cooling-water communicating portion opening is provided between the first upper fastening portion and the second upper fastening portion in the upper mounting face.

4. The water pump mounting structure according to claim 1, wherein the first lower fastening portion and the second lower fastening portion of the lower extending portion are located on respective opposite sides of an oil passage opening of an oil passage provided in the engine body, and wherein the lower mounting face of the lower extending portion closes the oil passage opening when the water pump is mounted on the side wall of the engine body.

5. The water pump mounting structure according to claim 1, wherein a distance from the first lower fastening portion to the water pump cover is less than a distance from the first upper fastening portion to the water pump cover.

6. The water pump mounting structure according to claim 1, wherein a distance from the first lower fastening portion to the pump driving shaft is less than a distance from the first upper fastening portion to the pump driving shaft.

7. The water pump mounting structure according to claim 1, wherein a distance from the second lower fastening portion to the water pump cover is less than a distance from the second upper fastening portion to the water pump cover.

8. The water pump mounting structure according to claim 1, wherein a distance from the second lower fastening portion to the pump driving shaft is less than a distance from the second upper fastening portion to the pump driving shaft.

9. The water pump mounting structure according to claim 1, wherein the second upper fastening portion is provided linearly between the first upper fastening portion and the pump driving shaft.

* * * * *